US008882496B2

(12) United States Patent
Dickmann et al.

(10) Patent No.: US 8,882,496 B2
(45) Date of Patent: Nov. 11, 2014

(54) CONTAINER CANDLE, INSERT THEREFOR AND METHOD OF MAKING

(75) Inventors: Bradley J. Dickmann, Burlington, WI (US); Steven W. Ivanisko, Brantford (CA); Kara L. Lakatos, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 399 days.

(21) Appl. No.: 13/091,786

(22) Filed: Apr. 21, 2011

(65) Prior Publication Data

US 2012/0270164 A1 Oct. 25, 2012

(51) Int. Cl.

| | |
|---|---|
| ***F23D 3/16*** | (2006.01) |
| ***C11C 5/00*** | (2006.01) |
| ***C11C 5/02*** | (2006.01) |

(52) U.S. Cl.
CPC .. *C11C 5/008* (2013.01); *C11C 5/02* (2013.01)
USPC ..... 431/291; 431/288; 431/35; 362/161

(58) Field of Classification Search
USPC ..... 431/288, 291, 35; 362/161
See application file for complete search history.

(56) References Cited

U.S. PATENT DOCUMENTS

| | | | | |
|---|---|---|---|---|
| 2,354,343 | A * | 7/1944 | Webber et al. | 431/289 |
| 2,516,441 | A * | 7/1950 | Winsor | 431/125 |
| 3,283,546 | A * | 11/1966 | Matsui | 431/126 |
| 3,752,433 | A | 8/1973 | Berman | |
| 3,998,922 | A | 12/1976 | Weiss | |
| 4,028,045 | A | 6/1977 | Reiher | |
| 4,427,366 | A | 1/1984 | Moore | |
| 4,568,270 | A * | 2/1986 | Marcus et al. | 431/288 |
| 5,395,233 | A * | 3/1995 | Karp | 431/289 |
| 5,842,850 | A | 12/1998 | Pappas | |
| 5,939,005 | A | 8/1999 | Materna | |
| 6,033,210 | A | 3/2000 | Freeman | |
| 6,062,847 | A | 5/2000 | Pappas | |
| 6,129,771 | A * | 10/2000 | Ficke et al. | 44/275 |
| 6,155,451 | A * | 12/2000 | Pietruch et al. | 220/608 |
| 6,241,512 | B1 | 6/2001 | Freeman et al. | |

(Continued)

FOREIGN PATENT DOCUMENTS

| | | | |
|---|---|---|---|
| EP | 1760139 | A1 | 3/2007 |
| JP | 2006022292 | A | 1/2006 |
| WO | 03099976 | A1 | 12/2003 |

OTHER PUBLICATIONS

PCT/US2012/034184 International Search Report dated Jul. 2, 2012.

*Primary Examiner* — Jorge Pereiro

(57) ABSTRACT

A container candle having improved burn performance and fragrance delivery is described. The container candle includes a container, a non-cylindrical insert with wick, and a fill material. The non-cylindrical insert provides auto-centering of the wick in the container candle and even burning of the candle by centrally positioning and retention of the wick in the container. The non-cylindrical insert has a top surface which transitions into tapered side walls which in turn transition to a base having a bottom surface, with the top surface being of a lesser diameter than the diameter of the bottom surface. An upper portion of the wick extends beyond the top surface of the insert. The fill material is situated in the container around the insert in an amount at least substantially sufficient to cover the insert but not cover the upper portion of the wick extending out of the insert.

13 Claims, 2 Drawing Sheets

(56) References Cited

U.S. PATENT DOCUMENTS

| | | | | |
|---|---|---|---|---|
| 6,296,477 | B1 * | 10/2001 | Lin | 431/291 |
| 6,397,562 | B1 * | 6/2002 | Herrhammer | 53/440 |
| 6,398,544 | B2 * | 6/2002 | Wright et al. | 431/291 |
| 6,409,501 | B1 * | 6/2002 | Pappas | 431/289 |
| 6,471,899 | B2 | 10/2002 | Daiber et al. | |
| 6,491,517 | B2 | 12/2002 | Freeman et al. | |
| 6,508,644 | B1 | 1/2003 | Pesu et al. | |
| D476,427 | S | 6/2003 | Pappas | |
| 6,640,558 | B1 | 11/2003 | Zenisek | |
| 6,793,484 | B2 | 9/2004 | Pesu et al. | |
| 6,923,639 | B2 | 8/2005 | Pesu et al. | |
| 7,232,550 | B1 | 6/2007 | Rodgers et al. | |
| 7,261,848 | B2 * | 8/2007 | Yekutiely | 264/112 |
| 7,722,352 | B2 | 5/2010 | Kubicek et al. | |
| 7,736,145 | B1 * | 6/2010 | Horvath et al. | 431/291 |
| 7,959,689 | B2 * | 6/2011 | Cagle | 44/275 |
| 2001/0053506 | A1 | 12/2001 | Moon | |
| 2002/0129808 | A1 * | 9/2002 | Manner | 126/45 |
| 2003/0064340 | A1 * | 4/2003 | Pappas | 431/298 |
| 2003/0235796 | A1 * | 12/2003 | Yekutiely | 431/291 |
| 2004/0029061 | A1 | 2/2004 | Dibnah et al. | |
| 2004/0033463 | A1 | 2/2004 | Pesu et al. | |
| 2004/0201123 | A1 * | 10/2004 | Yekutiely | 264/138 |
| 2005/0023714 | A1 * | 2/2005 | Manner | 264/115 |
| 2005/0227190 | A1 * | 10/2005 | Pappas | 431/35 |
| 2005/0266367 | A1 | 12/2005 | Kay et al. | |
| 2006/0057521 | A1 | 3/2006 | Kubicek et al. | |
| 2006/0172241 | A1 | 8/2006 | Hohertz | |
| 2007/0169405 | A1 * | 7/2007 | Cagle | 44/275 |
| 2007/0275336 | A1 | 11/2007 | Sun | |
| 2011/0294081 | A1 * | 12/2011 | McLaren et al. | 431/291 |
| 2012/0137634 | A1 * | 6/2012 | Cagle et al. | 53/431 |

* cited by examiner

CONTAINER CANDLE, INSERT THEREFOR AND METHOD OF MAKING

FIELD OF INVENTION

The present invention relates to a container candle and a method of making the container candle. More particularly, the invention relates to a container candle including a container, a non-cylindrical-shaped insert with wick, and filler wax, wherein the insert provides auto-centering of the wick in the container which provides for both improved burn performance and fragrance delivery.

BACKGROUND OF INVENTION

Various types of candles are known. Usage of candles since their early inception has changed dramatically from just providing light to providing ambiance and fragrance. Fragranced candles have become so popular that they come in a variety of shapes and structures. Candles desirably should burn to maximize fragrance release and provide an even burn of the candle so as to minimize the amount of fragrance and wax which are not released and burned during the life of the candle.

Since the proliferation of candles, consumers are more aware that not all candles are equal in performance. Candles can have different burn qualities as to evenness and cleanliness of burn and the degree of fragrance emitted and the length of time of such emission. Uneven burning can cause a large flame and sooty smoke and/or a tunneling effect in the candle which causes the candle material and fragrance to be wasted since it is not burned during the life of the candle. These latter candles are not able to be properly controlled during burning and, thus, do not provide complete combustion of the candle material. For example, in conventional cylindrical container candles, a significant amount of fragrance and dye are retained in unburned wax present in the base of the container and along the interior side walls of the container. This is a waste of fragrance, dye and wax material for the manufacturer which increases costs for making such candles and decreases the life of the candle for the consumer.

These and other shortcomings of container candles are addressed by the present invention.

SUMMARY OF THE INVENTION

The present invention relates to a container candle having improved burn performance and fragrance delivery. More particularly, the container candle comprises a container, a non-cylindrical insert of at least a combustible fuel and having a wick extending therethrough, and a fill material including a fragrance and at least one combustible fuel. The candle portion of the container candle includes the non-cylindrical insert, wick and fill material. The non-cylindrical insert, which has an upper portion which is narrower than its lower portion, provides auto-centering of the wick in the container and even burning of the candle by centrally positioning the wick in the container. Centering of the wick is critical for reducing heat on the side walls of the container for safety and good burn of the candle. The insert also provides support to the wick through the life of the burn to prevent slumping of the wick and uneven burning. The non-cylindrical insert includes a curved or angled top surface of a radius which transitions into tapered side walls which in turn transition to a base. The insert has a height which is less than a height of the container. The base of the insert has an outer diameter which is less than an inner diameter of a bottom wall of the container, but is sized to be sufficient in diameter to cause the insert to become auto-centered on the inside bottom wall of the container when placed thereon in the container. The configuration of the bottom of the insert as to size and shape is complementary to the shape of the outer container to provide auto-centering. An upper portion of the wick extends beyond the top surface of the insert. The fill material is provided in the container around the insert in an amount which can be sufficient to cover the top surface of the insert, or the fill material can be purposely below the top surface of the insert, but in either event not covering the upper portion of the wick extending out of the insert.

Accordingly, the shape and the positioning of the insert in the container provides for (1) auto-centering of the wick in the container; (2) a clean pour, i.e., no air pocket formation, of fill material into the container and around the insert due to the curvature or angle and taper of the side walls of the insert; and (3) an even burn of the fill material and insert to enable dispersal of fragrance from the insert and/or fill material. Minimizing or eliminating waste of fragrance, dye and candle material of the container candle is thereby achieved.

The above and other aspects of the present invention will be apparent from the following description of preferred embodiments of the invention and from the accompanying drawings.

BRIEF DESCRIPTION OF THE DRAWINGS

The following detailed description of specific non-limiting embodiments of the present invention can be best understood when read in conjunction with the following drawings, where like structures are indicated with like reference numbers.

DETAILED DESCRIPTION OF THE PREFERRED EMBODIMENTS

Figure 1:
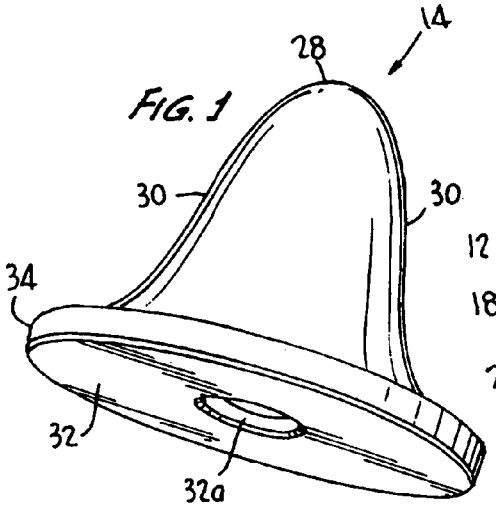
FIG. 1 illustrates a perspective view of a preferred embodiment of the invention, i.e., a bell-shaped insert, for a container candle of the invention.

The present invention relates to a non-cylindrical insert for placement in an outer container to provide a container candle. The insert can be of various configurations wherein the upper portion of the insert is narrower in diameter than the diameter of the bottom portion of the insert. The sidewalls between the top surface of the upper portion and the base of the bottom portion of the insert transition between the top surface and the base. The non-cylindrical insert can have various shapes, such as shown for example in FIG. 1 and FIGS. 5-9. For the purpose of ease of discussion, the invention will be described primarily with reference to the preferred embodiment of a bell-shaped insert as shown in FIGS. 1-4. It is to be understood, however, that the description of the bell-shaped insert is also applicable to the other embodiments of the insert, e.g., as shown in FIGS. 5-9 and as otherwise described herein.

Referring to FIGS. 1-4, the present invention relates to a container candle 10 having improved burn performance and fragrance delivery. More particularly, the container candle 10 comprises a container 12, a bell-shaped insert 14, a wick 16 and a fill material 18, wherein the insert 14, wick 16 and fill material 18 form the candle portion 20 of the container candle 10.

The container 12 has an open top 22 in use, side walls 24 and a bottom wall 26. The container 12 may be of any suitable shape and is preferably round, circular or cylindrical, but may also be square, oval, pentagonal, hexagonal, octagonal, other geometrical shapes or the like. The side walls 24 of the container 12 are preferably substantially straight or vertical as to the base 26 with a top peripheral edge. However, the side walls 24 may be any other suitable shape including, but not limited to, substantially curved upper peripheral edge, or the like. The top peripheral edge may be straight, rounded, or otherwise based on the desired structural design or aesthetic appearance sought. The container 12 can be made of any suitable material including, but not limited to, glass, metal, plastic, ceramic, a combination thereof, and the like.

The insert 14 holds the wick 16 centrally in the container 12. The insert 14 has a top surface 28 transitioning into tapered side walls 30 which in turn transition to a base 32. The base 32 of the bell-shaped insert has substantially straight vertical side walls 34. The insert 14 has a height which is less than a height of the container 12, and the base 32 of the insert 14 has an outer diameter which is less than an inner diameter of the interior bottom wall 26 of the container 12. The base 32 is sufficient in diameter to cause the insert 14 to become auto-centered on the inside surface 26*a* of the bottom wall 26 of the container 12 when placed thereon in the container 12. The insert 14 comprises at least a combustible fuel, such as wax including, but not limited to, paraffin, vegetable-based wax (e.g. soy-based wax), gel, any blend of these, and the like. The insert 14 may also include therein fragrance(s), dye(s) and/or other additive(s) which enhance the burn performance or fragrance experience of the candle.

Figure 2:
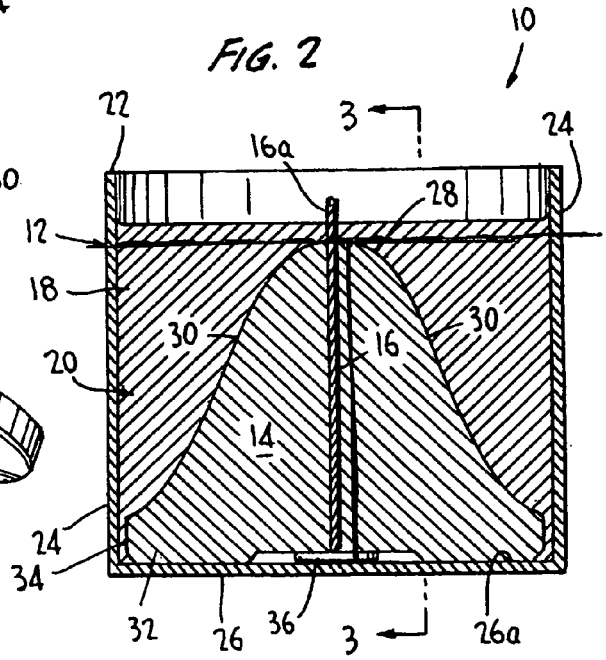
FIG. 2 illustrates cross-sectional side view of the container candle of the invention having the bell-shaped insert of FIG. 1 therein.
Figure 3:
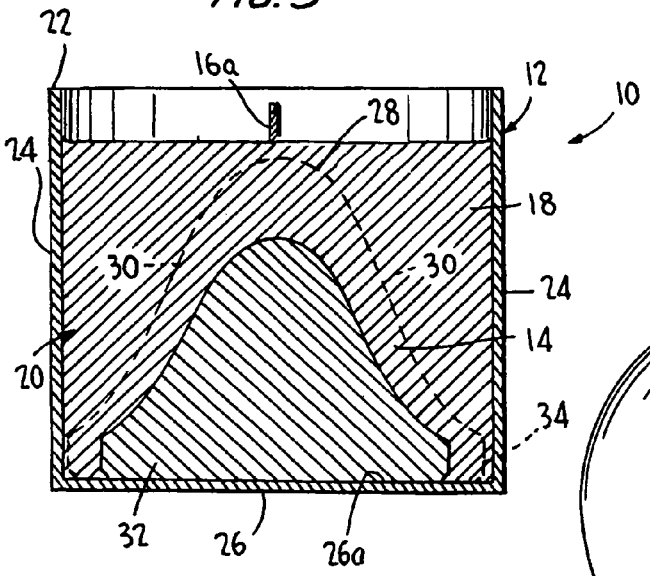
FIG. 3 illustrates a cross-sectional side view of the container candle of FIG. 2 along the line 3-3.
Figure 4:
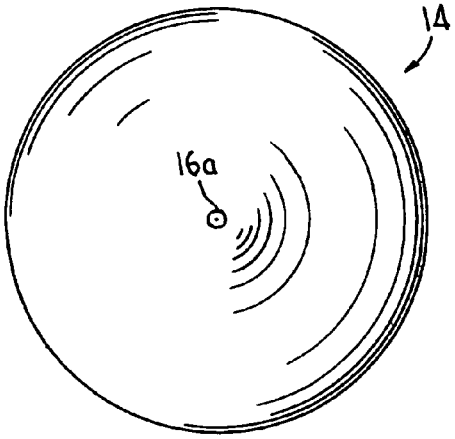
FIG. 4 illustrates a top view of the bell-shaped insert of FIG. 1.

The wick 16 extends centrally through the insert 14 with an upper portion 16*a* of the wick 16 extending beyond the top surface 28 of the insert 14. The wick 16 may be made of any suitable wick material. In one embodiment as shown in FIG. 2, the base of the wick may be attached to a wick holder 36, i.e., wick clip or stand, so that once the wick 16 burns down to the base of the wick the flame will automatically be extinguished. The wick holder 36 may be any suitable clip or stand and may be connected to the wick 16 in any suitable manner. The wick holder is preferably embedded in the base 32 of the insert 14, such as shown in FIG. 2. The embedment results in the base of the wick holder being flush with the bottom wall of base 32. Alternatively, FIG. 1 shows a recess 32*a* formed in the base to receive a wick holder. The wick holder may or may not be adhered to the base wall of the container by a glue, wax or other suitable material, when the insert is placed therein.

The fill material 18 is situated in the container 12 around the insert 14 preferably in an amount sufficient to cover the top surface 28 of the insert 14 but not cover the upper portion 16*a* of the wick 16 extending out of the insert 14 and be below a top edge of the side walls 24 of the container 12. Alternatively, the fill material may purposely leave exposed a portion of the insert containing the upper portion 16*a* of the wick 16. The fill material 18 comprises at least one fragrance and at least one combustible fuel, such as wax including, but not limited to, paraffin, vegetable-based wax (e.g. soy-based wax), gels, blends of these, and the like. The fill material can also include one or more dyes or other additive(s) suitable for incorporation in a candle. Based on 100 wt. % of the total amount of fragrance contained in the container candle, i.e., of the insert and the fill material, fragrance is delivered in an amount of greater than about 98 wt. % upon end of life of the wick.

The fragrance of the insert 14 and the fragrance of the fill material 18 can be the same or different from each other.

Retention of combustible fuel within the container 12 upon end of life of the wick 16 is designed to be less than about 10 wt. % based on 100 wt. % being a sum of the combustible fuel of the fill material 18 and the combustible fuel of the insert 14.

In one embodiment of the invention, the insert 14 is used in making a container candle 10 having a cylindrical outer container 12. The insert 14 is placed in the container 12 on the interior surface 26*a* of the bottom wall 26 of the container 12 with the base 32 of the insert 14 facing the interior surface 26*a* of the bottom wall 26 of the container 12. Due to the outer diameter of base 32 being sized just smaller than the inner diameter of the container, ready insertion of the insert is provided with minimal subsequent movement of the insert within the container which thereby achieves auto-centering of the insert wick therein. Centering of a cylindrical insert is difficult and time consuming, and the tunneling effect occurs upon burning of the candle resulting in a waste of candle material and fragrance. Fill material 18 is poured into the container 12 around the insert 14 so that the insert 14 is covered by the fill material 18 with the wick 16 protruding beyond the fill material 18. The curvature or angle and taper of the side walls 30 of the insert 14 provide a clean pour of fill material 18 into the container 12 and around the insert 14 without air pockets so that the fill material 18 smoothly abuts the side walls 30 of the insert 14.

Further, when the insert 14 is placed in the container 12, the base 32 of the insert 14 may optionally be adhered to the top surface 26*a* of base wall 26 of the container 12. Due to the minimal movement of insert 14 in container 12, such adhering is not required, but such provides an added safety feature in fit and retention between the candle components and the container.

The bell-shaped insert 14 may be any suitable size such that the base 32 of the bell-shaped insert 14 is slightly smaller than the interior diameter of the container 12 in which it is inserted and the height of the bell-shaped insert 14 is less than the height of the container 12. In one embodiment, the candle 20 formed in the container 12 is sized as a votive candle. As such, after the fill material 18 is poured into the container 12 over the bell-shaped insert 14, the candle 20 has a height of approximately 2 inches (50.8 mm). The bell-shaped insert 14 has a height of approximately 1.65 inches (41.91 mm) and the outer diameter of the base 32 of the bell-shaped insert 14 is approximately 1.75 inches (44.45 mm) and is about a few millimeters smaller, preferably in a range of about 2 mm to about 4 mm smaller, and in the embodiment described above about 4 mm smaller, than the inner diameter of the container 12. This preferred range allows for an annulus of about 1 mm to about 2 mm clearance between the insert and the outer container which provides for a looseness allowing ready insertion of the insert 14 while also allowing only minimal subsequent movement of the insert 14 in the container 12, both prior to and during the pouring of the fill material 18 into the container 12. This structure provides auto-centering of the insert 14 in the container 12 upon placement in the container 12, as well as allows the fill material to sufficiently overpour the insert to hide the insert from view in the finished container candle. The centering of the wick 16 also then occurs which results in good temperature control as to the burning, i.e., a centered heat/burn and an even burn on all sides of the candle is provided which reduces heat to the container side walls for safety and good burn of the candle. This prevents also heat from being reduced too much during burn of the wax which avoids a tunneling effect in the candle, i.e., avoids wax remaining along the interior side walls of the container and the attendant waste of fragrance and wax (which is added cost to the manufacturer) and reduction in life of the candle (which is a loss to the consumer as to the useful life of the candle).

As set forth above, the insert 14 of the invention provides, in addition to centering of the wick 16, also provides support to the wick 16. The support prevents slumping of the wick 16 during the life of the burn. This is especially beneficial if a soy-based candle is desired for use since soy-based candles have a faster melt time.

Due to the improved temperature control and burn achieved by the insert 14 of the invention, especially as to the preferred embodiment of the bell-shaped insert, minimization of the amount of unused fragrance and dye is achieved. Reducing the residual loss of fragrance and dye at the end of life of the candle in unburned candle material results in a financial savings to the manufacturer while providing an improved life length to the consumer.

It is noted that while the container candles 10 of the present invention are preferably fragranced candles which are burned in households to provide ambience, fragrance or elimination of odors, the container candles 10 may be unfragranced. Unfragranced candles embodying the invention still results in improved temperature control and burn and, thus, a longer useful life due to minimal waste of candle material, i.e., no tunneling effect.

Figure 5:
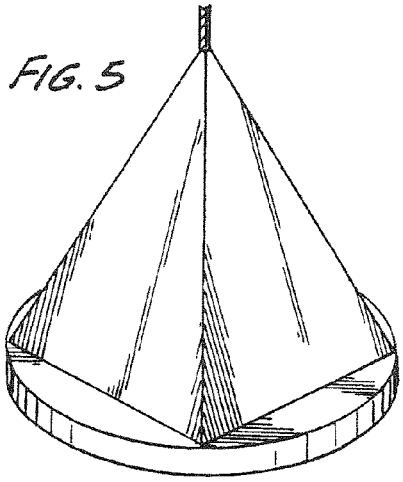
FIG. 5 illustrates a further embodiment of a non-cylindrical insert of the invention having a pyramidal shape with cylindrical base as shown or without the cylindrical base.
Figure 6:
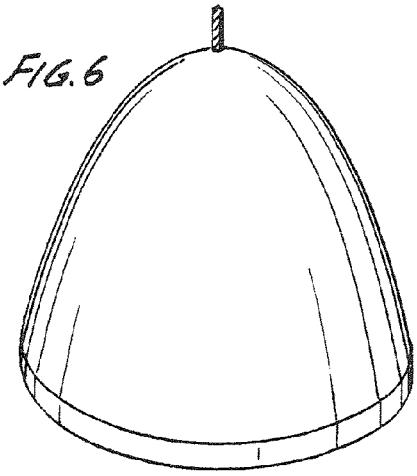
FIG. 6 illustrates a further embodiment of a non-cylindrical insert of the invention having a dome shape.
Figure 7:
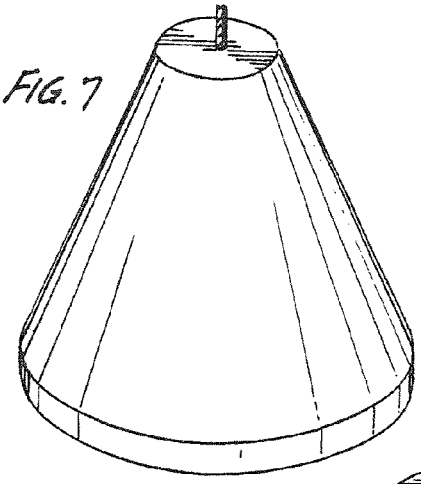
FIG. 7 illustrates a further embodiment of a non-cylindrical insert of the invention of modified cone shape.
Figure 8:
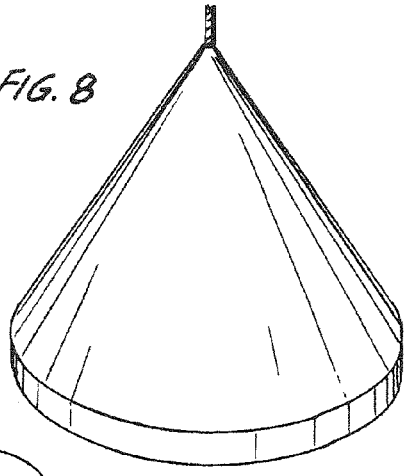
FIG. 8 illustrates a further embodiment of a non-cylindrical insert of the invention which is cone-shaped.
Figure 9:
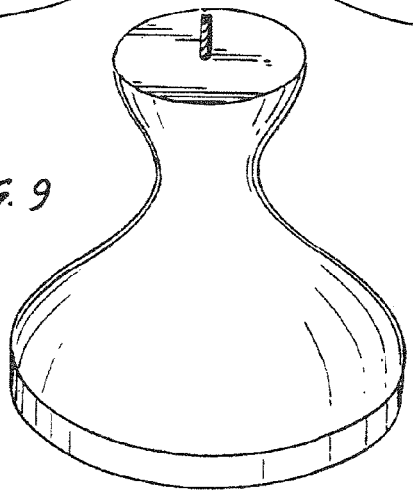
FIG. 9 illustrates a further embodiment of a non-cylindrical insert of the invention which has a modified hourglass shape.

Alternative embodiments of the non-cylindrical insert of the invention are shown in FIGS. 5-9. Generally, the insert has a narrower top surface than bottom surface wherein the top surface is curved or angled into tapering sidewalls which extend to the bottom surface. The base of the insert has a size and configuration which complements the interior size of an outer container into which the insert is placed so as to achieve the auto-centering of the insert and wick within the container. FIG. 5 shows a pyramidal-shaped insert. The insert of FIG. 5 can include the pyramidal body with or without the cylindrical base as shown. FIG. 6 shows a dome-shaped insert. FIG. 7 shows a modified cone-shaped insert. FIG. 8 shows a conical insert. FIG. 9 shows a modified hourglass shaped insert. All the insert shapes are narrower in the upper portion of the insert as compared to the lower portion of the insert.

Table 1 illustrates an example of a paraffin candle of the invention which is 2.00 inches in height with a bell-shaped paraffin insert therein having a height of 1.50 inches, compared to a single piece cylindrical paraffin candle also 2.0 inches in height. Each candle was cut horizontally into 0.25 inch sections (8 sections total) and weighed. Each candle had a total fill weight of 115 grams, resulting in each 0.25 section being 14.375 grams (14.375 g×8=115 g). The percentage of fragrance by section is listed in Table 1, as well as the weight of the bell-shaped insert in each cut section.

TABLE 1

| Comparison Candle Fragrance % By Section | Inventive Candle Fragrance % By Section | Inventive Candle Insert Weight By Section |
|---|---|---|
| 5.5% | 5.5% | — |
| 5.5% | 5.5% | — |
| 4.0% | 3.78% | 0.8 gms |
| 4.0% | 3.75% | 0.9 gms |
| 4.0% | 3.58% | 1.5 gms |
| 4.0% | 2.89% | 4.0 gms |
| 4.0% | 2.16% | 6.6 gms |
| 4.0% | 0.83% | 11.4 gms |

Table 2 illustrates mixed pours with differing fragrance levels.

TABLE 2

| Flame Position | Insert Weight | Fill Weight | 80/20 pour @ 5.5% and 4.0% | 80/20 pour @ 4.25% and 5.5% | 90/10 pour @ 5.5% and 4.0% | 90/10 pour @ 5.5% and 4.25% | 50/50 pour @ 5.5% and 4.0% |
|---|---|---|---|---|---|---|---|
| 2.00-1.75" | 0.0 | 14.375 | 5.5% | 5.5% | 5.5% | 5.5% | 5.5% |
| 1.75-1.50" | 0.0 | 14.375 | 5.5% | 5.5% | 4.0% | 4.3% | 5.5% |
| 1.50-1.25" | 0.7 | 14.375 | 3.8% | 4.0% | 3.8% | 4.0% | 5.2% |
| 1.25-1.00" | 1.3 | 14.375 | 3.6% | 3.9% | 3.6% | 3.9% | 3.9% |
| 1.00-0.75" | 2.5 | 14.375 | 3.3% | 3.5% | 3.3% | 3.5% | 3.5% |
| 0.75-0.50" | 4.5 | 14.375 | 2.7% | 2.9% | 2.7% | 2.9% | 2.9% |
| 0.50-0.25" | 7.5 | 14.375 | 1.9% | 2.0% | 1.9% | 2.0% | 2.0% |
| 0.25-0.00" | 13.0 | 14.375 | 0.4% | 0.4% | 0.4% | 0.4% | 0.4% |

Based on a 30 gram bell-shaped insert.

Tables 1 and 2 above show that the bell-shaped insert allows for best fragrance delivery during the first 75%-80% of candle life. The last ¼ of candle life shows fall off in fragrance delivery and the last ⅛ of candle life is retention. As such, cost savings can be maximized by using a bell-shaped insert while maintaining good fragrance delivery for 75%-80% of the total candle life.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A container candle having improved burn performance and fragrance delivery comprising:

a non-meltable outer container having an open top in use, side walls and a bottom wall;

a non-cylindrical insert wherein an upper portion of the insert is narrower in diameter than diameter of a bottom-most portion of the insert, said insert having a top wall which transitions into tapered side walls which in turn transition to a base with a bottom surface, said bottom surface being essentially parallel to an uppermost outer surface of the top wall of the insert, wherein the non-cylindrical insert has a height which is less than the height of the container, the base has a diameter which is less than an inner diameter of the bottom wall of the container but is sufficient in diameter to cause said non-cylindrical insert to become auto-centered on the bottom wall of the container when placed thereon in the container, and said non-cylindrical insert comprising at least one combustible fuel;

a wick extending centrally through the non-cylindrical insert with an upper portion of the wick extending beyond the top wall of the non-cylindrical insert; and a fill material comprising at least one fragrance and at least one combustible fuel, said fill material being situated in said container around said non-cylindrical insert without air pockets formed therein in an amount sufficient to at least substantially cover the non-cylindrical insert but not cover said upper portion of the wick extending out of the insert and be below a top edge of the side walls of said container;

wherein based on shape and positioning of said insert, retention of combustible fuel within the container upon end of life of the wick is less than about 10 wt. % based on 100 wt. % being a sum of said combustible fuel of said fill material and said combustible fuel of said insert, and wherein based on said shape and positioning of said insert, said fill material avoids a tunneling effect upon burning thereof.

2. The container candle of claim 1, wherein said fragrance, based on 100 wt. % of the fragrance contained in said fill material and said insert, is delivered in an amount of greater than about 98 wt. % upon end of life of the wick.

3. The container candle of claim 1, wherein said insert is a bell-shaped insert.

4. The container candle of claim 1, wherein said non-cylindrical insert is a pyramidal-shaped insert.

5. The container candle of claim 1, wherein said non-cylindrical insert is a domed-shaped insert.

6. The container candle of claim 1, wherein said non-cylindrical insert is a conical-shaped insert or a substantially conical-shaped insert.

7. The container candle of claim 1, wherein said non-cylindrical insert is configured as an hourglass wherein a top portion of the hourglass is of a lesser width than a bottom portion of the hourglass.

8. The container candle of claim 1, wherein said fill material further comprises at least one dye.

9. The container candle of claim 1, wherein said insert further comprises at least one fragrance.

10. The container candle of claim 9, wherein said at least one fragrance of the insert and said at least one fragrance of the fill material are different from each other.

11. The container candle of claim 1, further comprising a wick holder in the base of the insert for holding a bottom end of the wick.

12. A method of making a container candle having improved burn performance and fragrance delivery comprising:

placing a non-cylindrical insert in a non-meltable outer container having an open top in use, side walls and a bottom wall, wherein the non-cylindrical insert has an upper portion which is narrower in diameter than diameter of a bottommost portion of the insert, and wherein said insert has a top wall which transitions into tapered side walls which in turn transition to a base with a bottom surface, said bottom surface being essentially parallel to an uppermost outer surface of the top wall of the insert, wherein the non-cylindrical insert has a height which is less than the height of the container, the base has a diameter which is less than an inner diameter of the bottom wall of the container but is sufficient in diameter to cause said non-cylindrical insert to become auto-centered on the bottom wall of the container when placed thereon in the container, and said non-cylindrical insert comprising at least one combustible fuel and having a wick extending centrally therethrough with an upper portion of the wick extending beyond the top wall of the non-cylindrical insert; and filling the container containing the non-cylindrical insert without air pocket formation with a fill material comprising at least one fragrance and at least one combustible fuel, such that said fill material is situated in said container around said non-cylindrical insert in an amount sufficient to at least substantially cover the non-cylindrical insert but not cover said upper portion of the wick extending out of the insert and be below a top edge of the side walls of said container; and wherein said shape and positioning of said insert are provided so that said fill materials avoids a tunneling effect upon burning thereof.

13. The method of making a container candle of claim 12, further comprising adhering the bottom surface of the base to an inner surface of the bottom wall of the container prior to filling the container with the fill material.

* * * * *